US006639512B1

(12) United States Patent
Lee et al.

(10) Patent No.: US 6,639,512 B1
(45) Date of Patent: Oct. 28, 2003

(54) ENVIRONMENTAL WARNING SYSTEM

(76) Inventors: Kyu-Woong Lee, 199 Balboa Dr., Milpitas, CA (US) 95035; Aaron M. Jungreis, 505A Sherwood Ct., Cary, NC (US) 27511

( * ) Notice: Subject to any disclaimer, the term of this patent is extended or adjusted under 35 U.S.C. 154(b) by 0 days.

(21) Appl. No.: 09/115,772

(22) Filed: Jul. 15, 1998

(51) Int. Cl.[7] ..... G08B 1/08

(52) U.S. Cl. ..... 340/539; 340/425.5; 340/426; 340/429; 340/460

(58) Field of Search ..... 340/425.5, 426, 340/429, 438, 460, 459, 584, 632, 825.44, 825.45, 825.46, 311.1, 539

(56) References Cited

U.S. PATENT DOCUMENTS

| | | | | | |
|---|---|---|---|---|---|
| 3,569,924 | A | | 3/1971 | Drake | |
| 3,575,555 | A | | 4/1971 | Schanne | |
| 3,632,887 | A | | 1/1972 | Leipp | |
| 3,870,818 | A | | 3/1975 | Barton | |
| 4,260,980 | A | | 4/1981 | Bates | |
| 4,278,963 | A | * | 7/1981 | Allen | 307/10.4 |
| 4,320,904 | A | * | 3/1982 | Walters et al. | 280/7.12 |
| 4,359,714 | A | * | 11/1982 | Tsunoda et al. | 340/460 |
| 4,389,546 | A | | 6/1983 | Glisson | |
| 4,428,685 | A | | 1/1984 | Lemelson | |
| 4,816,809 | A | | 3/1989 | Kim | |
| 4,894,642 | A | * | 1/1990 | Ashbaugh et al. | 340/539 |
| 5,081,722 | A | | 1/1992 | Yu | |
| 5,140,308 | A | * | 8/1992 | Tanaka | 340/539 |
| 5,250,945 | A | * | 10/1993 | Dombrowski | 340/901 |
| 5,319,350 | A | | 6/1994 | DeMarco | |
| 5,332,315 | A | | 7/1994 | Baker | |
| 5,420,580 | A | * | 5/1995 | Rawls | 340/936 |
| 5,446,934 | A | | 9/1995 | Frazier | |
| 5,536,076 | A | * | 7/1996 | Honold | 303/86 |
| 5,598,140 | A | * | 1/1997 | Eizen | 340/426 |
| 5,682,134 | A | * | 10/1997 | Stallbohm | 340/426 |
| 5,701,122 | A | * | 12/1997 | Canedy | 340/932.2 |
| 5,798,695 | A | * | 8/1998 | Metalis et al. | 340/576 |
| 5,801,618 | A | * | 9/1998 | Jenkins | 340/426 |
| 5,825,283 | A | * | 10/1998 | Camhi | 340/438 |
| 6,028,509 | A | * | 2/2000 | Rice | 340/449 |

* cited by examiner

*Primary Examiner*—Daryl Pope

(57) ABSTRACT

A system used to protect the occupants of a stationary motor vehicle, particularly unattended children and pets, from dangerous conditions occurring within the vehicle. The system comprises a sensor which senses dangerous environmental conditions such as high temperatures within the vehicle. In the preferred embodiment, the sensor is used with a transmitter to continuously transmit sound detected within the vehicle passenger compartment as well as transmitting information about any dangerous conditions which occur to a remotely located person. In a second embodiment, dangerous conditions trigger an alarm attached to the vehicle. The alarm amplifies the sound detected within the vehicle, such as a crying child, or a barking dog, and also produces a standard alarm sound alternated with an amplified voice declaring the dangerous condition. In a third embodiment, a sensor module attached to a wireless telephone informs a remotely located person of the dangerous condition through another wireless telephone or a pager.

14 Claims, 5 Drawing Sheets

ENVIRONMENTAL WARNING SYSTEM

BACKGROUND OF THE INVENTION

A person will frequently leave an infant, toddler, or pet within a car with the expectation that his or her time away from the car is not long enough to allow any hazard to the individual or animal within; however, the person may be delayed in his or her business. Furthermore, it can often be difficult for an individual to know where the line is between safe and unsafe conditions within the passenger compartment while he or she is not there. Unfortunately, too many times, the child or pet comes to harm because the environment within the car becomes unsafe. High temperatures are usually the culprit of the hazardous environment; however, other potential dangers exist such as freezing temperatures, high levels of carbon monoxide (CO) when the engine is left running, or people who pose a threat to the child or pet.

Although car alarms are available for burglar entry sensing, theft deterrence, or theft protection, these alarms are only capable of sensing automobile motion, shock, motion in the interior passenger compartment, or forced entry. They do not sense passenger compartment temperature or other conditions relating to an occupant's environment. Furthermore, the type of sound emitted by such car alarms is non-descriptive, so the sound produced by such alarms would provide little measure of safety for an infant caught inside a hot vehicle.

Inside a home, infants and toddlers are often monitored using baby monitors. FIG. 1 illustrates a typical baby monitor in block diagram form. It comprises two sections. The first section 100 comprises a microphone 110, a preamplifier 120, a transmitter 140, and a power supply 180. The second section comprises a receiver 200, and a loudspeaker or headphones 210. The power supply 180 is designed for use with small batteries and/or household voltage 300. It is not designed to operate from a 12 V car battery, or to plug into a cigarette lighter. Such baby monitors are designed primarily for use inside a home, and they are only designed to detect sound. The adult at the receiving end of the monitor 200 can thus often tell when a child has awakened or possibly when a child has been injured, but the adult is unaware of temperature or other environmental factors at the transmitter end. While such baby monitors are often adequate for the controlled environment of a typical home, the environment inside a motor vehicle is much less controlled, and a pet or sleeping child would be unable to report dangerous conditions to an adult listening at the other end of a standard baby monitor.

SUMMARY OF THE INVENTION

It is therefore an object of this invention to overcome the shortcomings of the prior art by providing a system which can sense dangerous conditions within a vehicle, and appropriately warn someone to come to the aid of a helpless passenger. To fulfill the object, the system is equipped with one or more sensing devices such as temperature sensors, CO sensors, microphones, or equipment for detecting motion near the exterior of the vehicle. The system is also equipped with apparatus that will appropriately warn someone of the dangerous condition in such a way as to instigate action.

The first and preferred embodiment of the invention comprises an enhanced baby monitor system, designed especially for use in vehicles, in which the transmitter comprises a temperature sensor, a CO sensor, and a means for conveying information about temperature and CO content along with the sound detected by its microphone. This embodiment also allows for an array of external motion detectors to be plugged into it in order to detect a person trying to break into the vehicle and thus pose a threat to the vehicle occupant.

Another embodiment comprises an enhanced car alarm system which comprises temperature sensors and CO sensors located inside the vehicle, as well as sensors to detect motion in the vicinity of the vehicle. The alarm also comprises means to convey information about a dangerous condition in the form of simulated voice, so that in the event of a dangerous condition, the alarm broadcasts a standard alarm sound alternated with the simulated voice as well as amplifying the sound inside the vehicle, such as a crying child.

A third embodiment of the invention comprises an environmental warning module which can attach to a wireless telephone. When a dangerous condition is sensed, the module uses the wireless telephone to report a message to a remotely located person. The message is reported through another telephone or through a pager.

DESCRIPTION OF EMBODIMENTS

The inventors propose a method of protecting a person or animal which has been left within a vehicle. The protection method combines several devices and technologies which are commonly available but heretofore have not been used in combination to create an environmental warning system for a person or animal left within a vehicle. This section describes in detail three embodiments of the environmental warning system.

Figure 1:
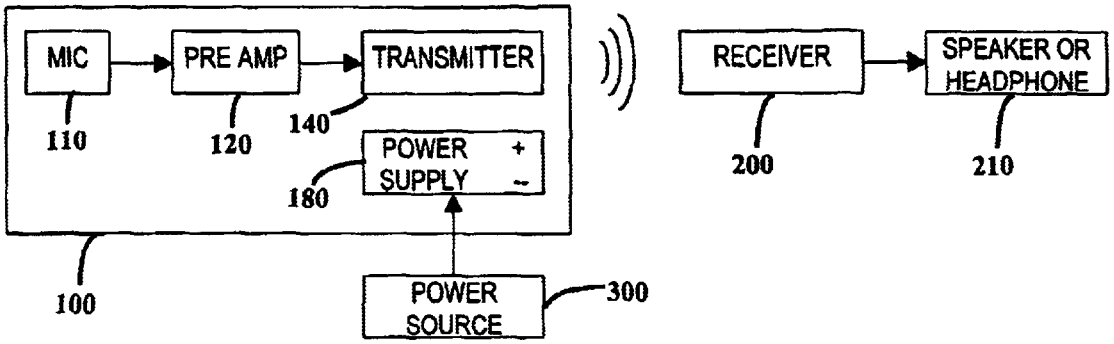
FIGURE 1 (PRIOR ART)
FIG. 1 is a block diagram of a conventional baby monitor.
Figure 2:
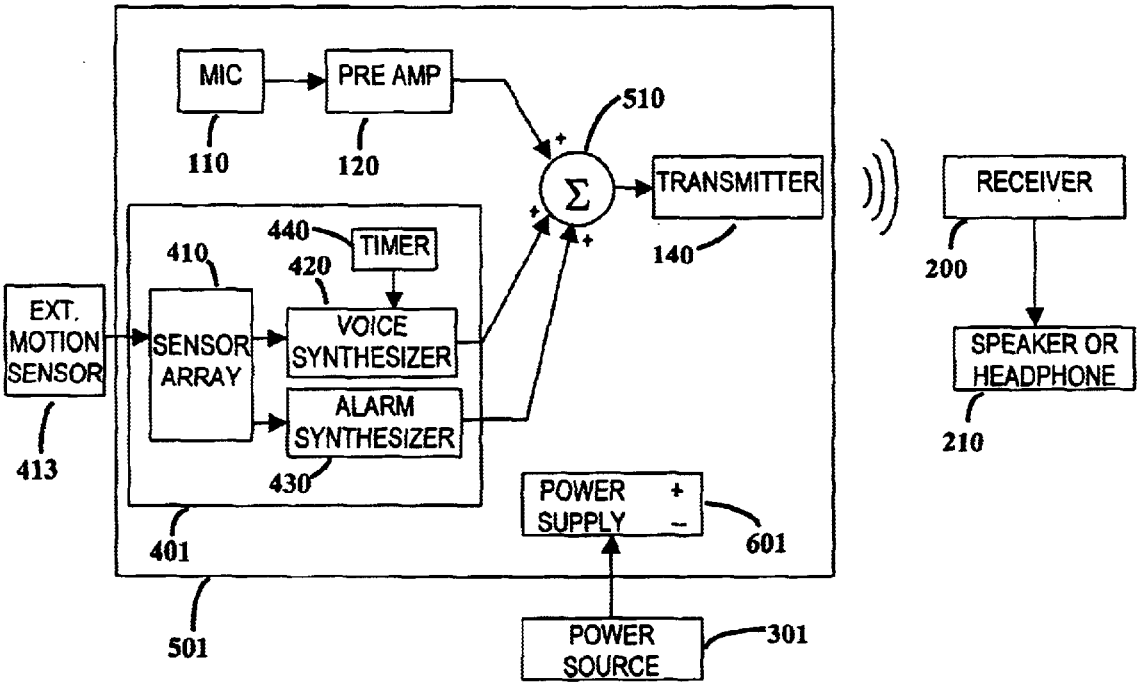
FIG. 2 is a block diagram of the preferred embodiment of the environmental warning system.
Figure 3:
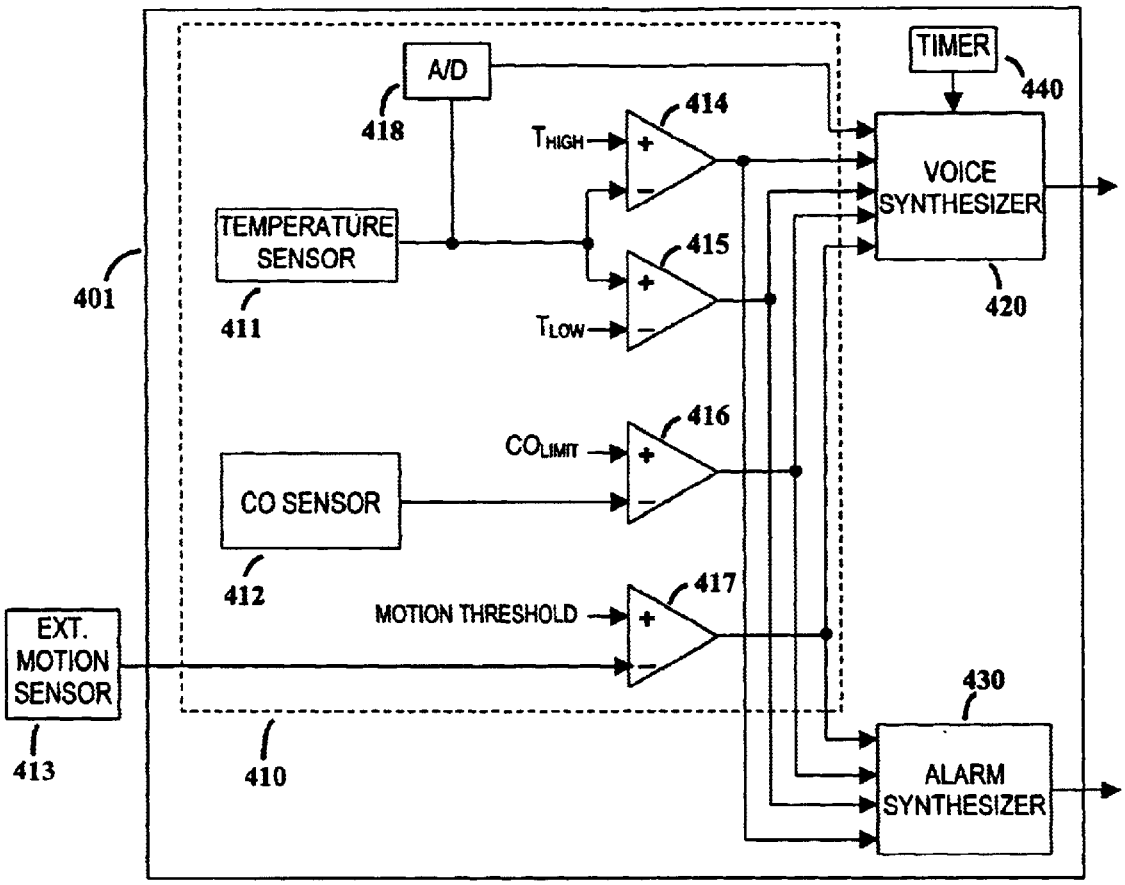
FIG. 3 is a block diagram of the environmental warning module of the embodiment of FIG. 2.

Refer to the accompanying figures. FIG. 2 is a block diagram of the first and preferred embodiment of the environmental warning system. The first embodiment of the environmental warning system comprises sensor-transmitter module 501, external motion sensors 413, receiver 200, and speaker or headphones 210. Sensor-transmitter module 501 further comprises environmental warning module 401, power supply 601, microphone 110, preamplifier 120, summer module 510, and transmitter 140. FIG. 3 shows more detail on environmental warning module 401 which comprises a sensor array 410, a voice synthesizer 420, an alarm synthesizer 430, and a timer 440. The sensor array 410 comprises temperature sensor 411, CO sensor 412, A/D converter 418, and comparators 414–417.

Figure 4:
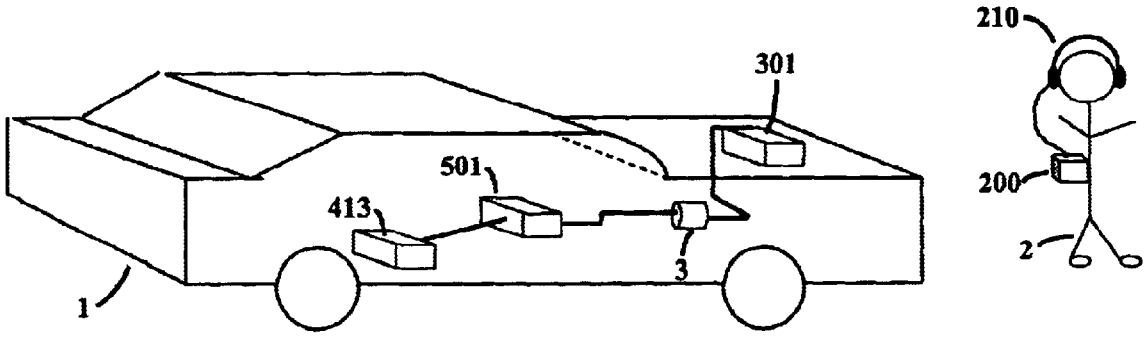
FIG. 4 shows the placement of the components of the embodiment of FIG. 2 into a vehicle and on a remotely located person.

FIG. 4 shows the placement of the components within a vehicle 1, and on a remotely located person 2. During normal operation, the remotely located person 2 hears the sound inside the passenger compartment of the vehicle 1, as well as being informed of the temperature inside the passenger compartment at predetermined intervals. When the environmental warning module 401 senses a dangerous condition, the remotely located person will continue to hear the sound inside the passenger compartment of the vehicle 1, as well as hearing an alarm sound alternated with a voice indicating the type of danger which exists.

This embodiment comprises apparatus which is similar to apparatus found in a conventional baby monitor system such as a microphone 110, a pre-amplifier 120, a transmitter 140, a receiver 200, and a loudspeaker or set of headphones 210. The power supply 601 in the preferred embodiment of the environmental warning system is designed to operate from any of the following power sources 301: a 12 V car battery (connected with a cigarette lighter plug 3), small portable batteries such as a transistor 9 V battery, and household voltage. It can thus be used in any application in which a standard baby monitor could be used, as well as being used inside a vehicle. Whereas a conventional baby monitor transmits the sound coming into the microphone 110, the first embodiment of the environmental warning system uses a summer module 510 to combine this sound with other signals coming from the environmental warning module 401 prior to transmission through transmitter 140.

As shown in FIG. 3, the sensor array 410 comprises sensors such as a temperature sensor 411, a CO sensor 412 and an array of comparators 414–417. It also receives signals from a remote array of external motion detectors 413. Comparator 414 compares the signal from the temperature signal with a preset temperature value representing an upper limit in tolerable temperature, such as 90° F. Similarly, comparator 415 compares the temperature with a lower limit such as 45° F. The values can be preset in the factory or adjusted by the user of the equipment. Comparator 416 compares the CO level against a preset limit. Comparator 417 compares the amount of motion in the vicinity of the vehicle against a limit which can be preset in the factory or adjusted by the user. When any of the sensors 411–413 sense a condition which is dangerous, then the corresponding comparator produces a logical 1. When any of the comparators 414–417 produce a logical 1, the alarm synthesizer 430 produces a signal which sounds to the remotely located person 2 like a typical alarm. When any of the comparators produce a logical 1, then the voice synthesizer 420 produces a voice signal which corresponds to the comparator which produced a logical 1. For example, if comparator 414 produces a logical 1, then the voice synthesizer would produce a signal which would cause the remotely located person 2 to hear words such as "the temperature in the car has reached dangerously high levels". Furthermore, the alarm sound and the voice sound would be alternated.

The temperature sensor signal is converted into a digital signal by analog-to-digital converter 418 and sent to inputs on the voice synthesizer 420. The signal comparison and processing can also be accomplished with other combinations of analog and digital signal processing such as is common to the art. Timer 440 causes the voice synthesizer to output temperature information at predetermined intervals, such as once per minute. The information would be spoken by simulating a voice saying, for example, "77 degrees Fahrenheit", or whatever the actual temperature is. Thus, while no dangerous signals are being sensed by sensors 411–413, the temperature is being verbally transmitted to the remotely located person so that he or she will be aware of temperature trends within the vehicle even before they reach dangerous levels.

Figure 5:
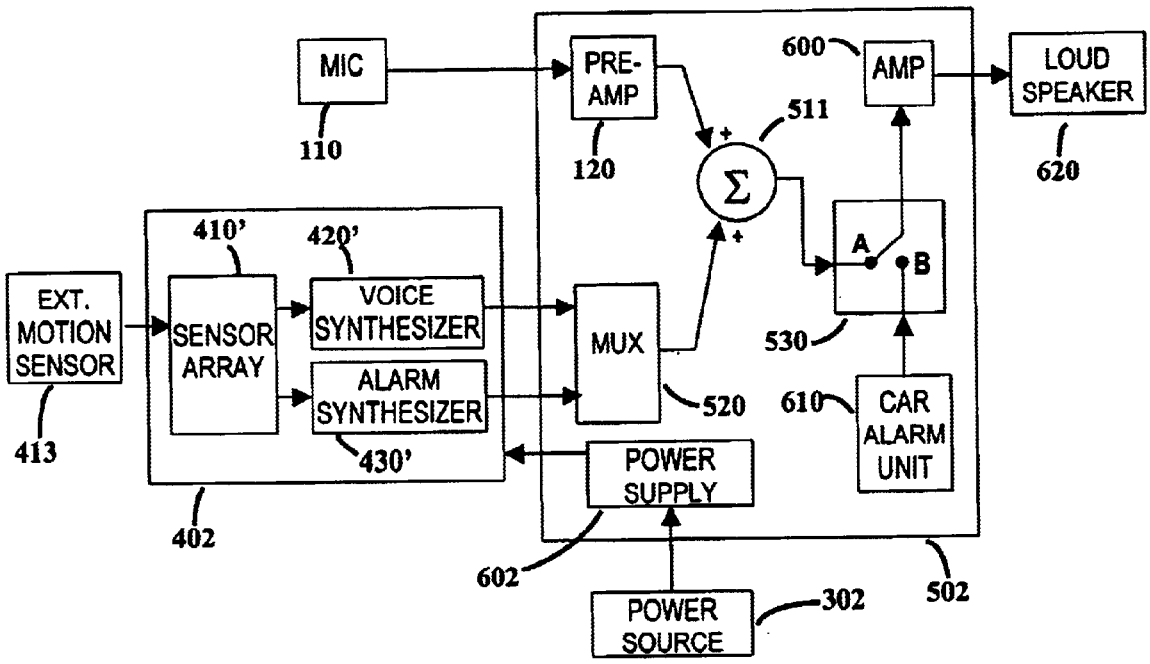
FIG. 5 is a block diagram of a second embodiment of the environmental warning system.
Figure 6:
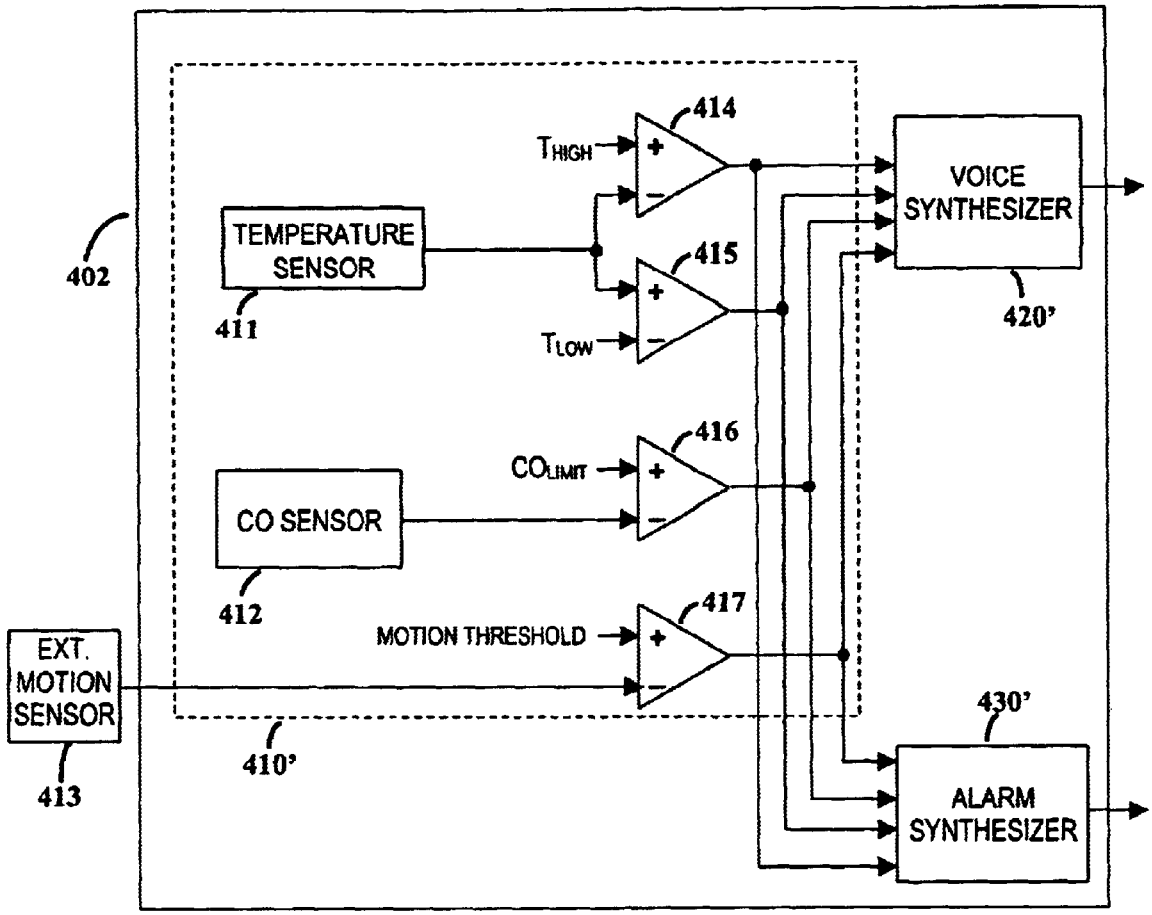
FIG. 6 is a block diagram of the environmental warning module of the embodiment of FIG. 5.
Figure 7:
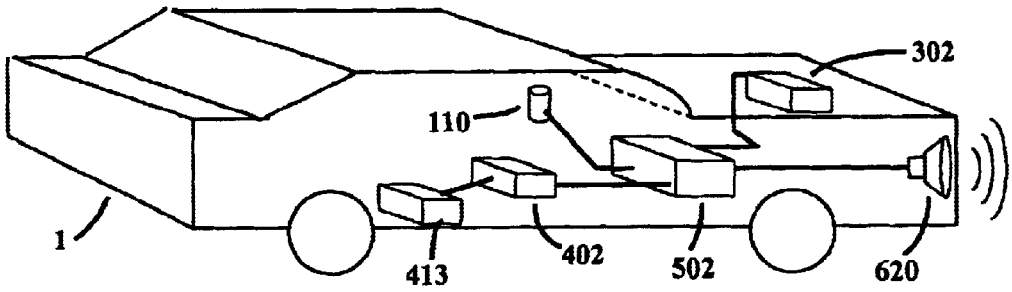
FIG. 7 shows the placement of the components of the embodiment of FIG. 5 into a vehicle.

FIG. 5 is a block diagram of a second embodiment of the environmental warning system. The second embodiment of the environmental warning system comprises environmental warning module 402, alarm system 502, microphone 110, external motion sensors 413, and loudspeaker 620. Environmental warning module 402 comprises a sensor array 410', a voice synthesizer 420', and an alarm synthesizer 430'. Alarm system 502 comprises multiplexor 520, summer module 511, preamplifier 120, switch 530, amplifier 600, car alarm unit 610, and power supply 602. FIG. 6 shows more detail on sensor array 410'. Sensor array 410' comprises temperature sensor 411, CO sensor 412, and comparators 414–417. FIG. 7 shows the placement of the components within a vehicle 1.

This second embodiment is capable of functioning as a standard car alarm, in addition to an environmental warning system. Switch 530 allows the user to choose between standard alarm operation, and environmental warning system operation. When the switch is in position B, car alarm unit 610 is connected to amplifier 600. Car alarm unit 610 when taken together with amplifier 600, loudspeaker 620, and power supply 602 can function as a standard car alarm. Car alarm unit 610 comprises the appropriate sensors and logic required of standard car alarms. The power supply 602 is designed to operate from a car battery power source 302.

When switch 530 is in position A, the system functions as an environmental warning system. When a dangerous condition is sensed by sensor array 410' or external motion detectors 413, then sensor array 410' sends signals to voice synthesizer 420' and alarm synthesizer 430'. Alarm synthesizer 430' synthesizes a standard alarm sound, and voice synthesizer 420' synthesizes a voice calling for help. Information about the type of danger is incorporated into the call for help. For example, if the temperature in the passenger compartment reaches dangerously high levels, the voice synthesizer 420' would produce a voice signal such as "Please help! Helpless vehicle occupant exposed to dangerously high temperatures". Multiplexor 520 alternates the voice signal with the standard alarm signal. Microphone 110 monitors the sound within the passenger compartment of the vehicle. Summer 511 adds the signal from microphone 110 to the signal from multiplexor 520. The signal from summer 511 is amplified by amplifier 600 and sent to the loudspeaker 620. The output at the loudspeaker would therefore be a standard alarm alternated with a voice calling for help; furthermore, the sound inside the passenger compartment, such as a crying child, would be superimposed on the alarm signal.

Figure 8:
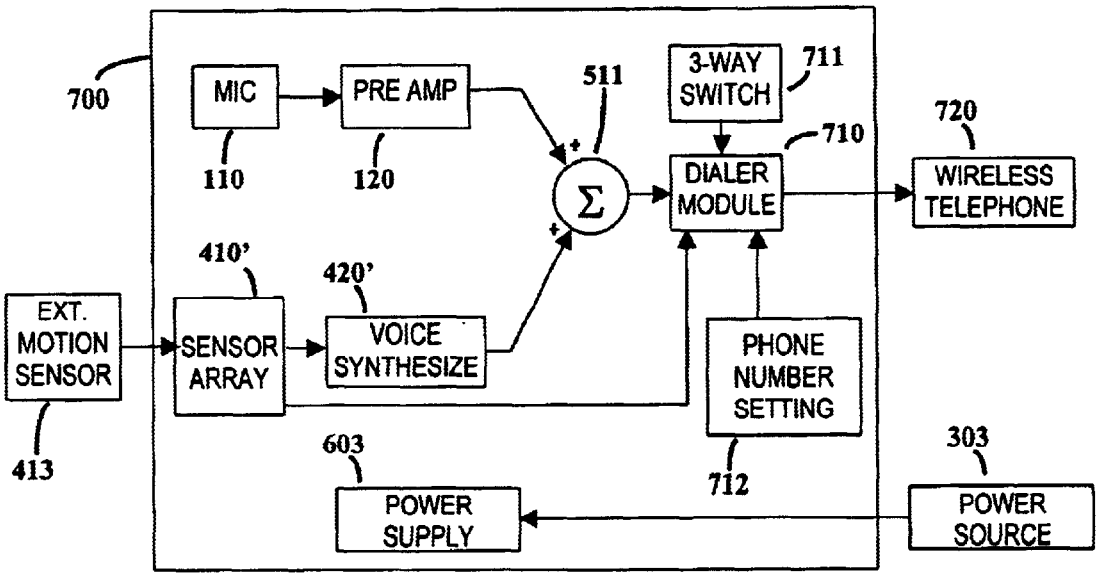
FIG. 8 is a block diagram of a third embodiment of the environmental warning system.

FIG. 8 is a block diagram of a third embodiment of the environmental warning system. The third embodiment of the environmental warning system comprises environmental warning module 700, external motion detectors 413, wireless telephone 720, and a telephone or pager 900. Environmental warning module 700 comprises microphone 110, preamplifier 120, sensor array 410', voice synthesizer 420', summer module 511, dialer module 710, 3-way switch 711, phone number setting 712, and power supply 603.

Figure 9:
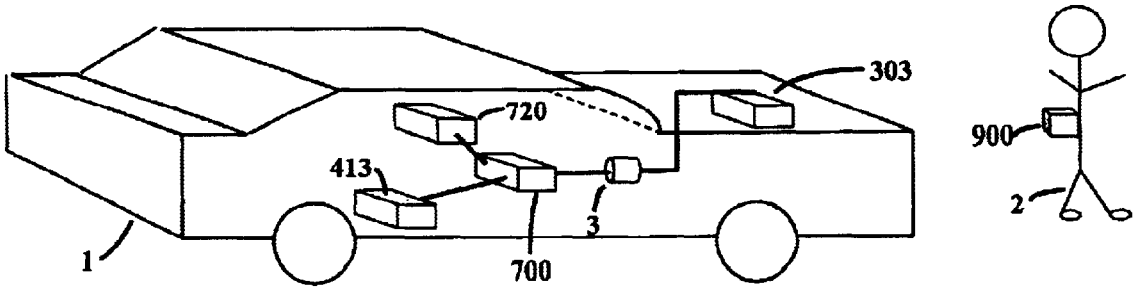
FIG. 9 shows the placement of the components of the embodiment of FIG. 8 into a vehicle and on a remotely located person.

FIG. 9 shows the placement of the components within a vehicle 1 and on remotely located person 2. The power supply 603 is capable from running off of a rechargeable battery pack or a car battery 303 via cigarette lighter plug 3. The operation of sensor array 410', external motion detectors 413, microphone 110, pre-amplifier 120, voice synthesizer 420', and summer 511 is the same as in the second embodiment. When sensor array 410' senses a dangerous condition, rather than triggering an alarm, it sends a signal to dialer module 710 which dials a prearranged telephone number 712 to inform a remotely located person 2 of the dangerous condition. The environmental warning module 700 allows the user to select from three different receiver types using 3-way switch 711. The three receiver types are (1) telephone, (2) numeric pager, and (3) alpha-numeric pager.

If option 1 (telephone) is chosen, and a dangerous condition occurs, the dialer sends sound signals from summer 511 to the wireless telephone. As in the second embodiment, the output from summer 511 comprises a voice calling for help superimposed on the sound within the passenger compartment, such as a crying child.

If option 2 (numeric pager) is chosen, and a dangerous condition occurs, the dialer sends a numeric code to the wireless telephone 720. The numeric code corresponds to a dangerous condition which can be understood by the remotely located person with the pager, based on prior arrangement. For example, the numeric message could be "505001" for a dangerously high temperature, "505002" for a dangerously low temperature, etc.

If option 3 (alpha-numeric pager) is chosen, and a dangerous condition occurs, the dialer sends an alpha-numeric code to the wireless telephone 720. This causes an alpha-numeric message to appear on the pager 900 of the remotely located person 2. The alpha-numeric message let's the person 2 know that a dangerous condition has occurred, and what that dangerous condition is.

The present invention is thus a warning system which detects dangerous environmental conditions in a parked automobile with trapped passengers, such as infants, toddlers, pet animals, or handicapped passengers, which could potentially save such passengers from harm or death.

While the above descriptions include many specificities, these should not be construed as limitations on the scope of the invention, but rather as exemplifications of embodiments thereof. Many other variations are possible. For example:

The system does not need to include all of the previously cited sensors in order to function as an environmental warning system;

The high/low temperatures could be used in conjunction with other sensors for motion or noise (cries for help);

Once a dangerous situation is signaled, not only could alarms be triggered, but signals could be sent to the owner, police, or other emergency services.

Environmental warning systems offered to consumers could have all detection/alarm features offered, with the option of activating certain selected features.

Multiple temperature sensors could be placed in the automobile to improve reliability of detecting dangerous temperature conditions.

The temperature information could be transmitted to the receiver at time intervals which vary with temperature so, for example, the information could be transmitted at shorter time intervals for more dangerous temperatures.

Signal processing and comparison of sensed conditions to predetermined conditions can be accomplished through many different methods, employing various combinations of analog and digital signal processing such as is common to the art.

The power supplies can be located external to the environmental warning modules (such as with ac adapters or battery packs) or internal to the modules.

The phone in the third embodiment can be either an external phone, or a phone circuit incorporated into the environmental warning system.

What is claimed:

1. A monitoring apparatus suitable for monitoring conditions inside a vehicle comprising:

a sound detector suitable for detecting the sounds made by an occupant inside said vehicle, a sensor for sensing conditions which could be potentially dangerous to an occupant of said vehicle and for generating warning information, a transmitter for transmitting said sound and said warning information, a receiver for processing said sound and said warning information, and for issuing an alarm which includes a combination of said sound and said warning information.

2.The apparatus of claim (1) in which the receiver comprises an amplifier and a loudspeaker attached to said vehicle.

3.The apparatus of claim (1) where the sensor comprises one from a group of:

a temperature sensor capable of distinguishing between temperature conditions which are either comfortable, uncomfortable, or dangerous to said vehicle occupant a sensor for a dangerous gas.

4. The apparatus of claim (1) where the transmitter comprises a wireless phone circuit.

5. The apparatus of claim (1) where the alarm generator comprises a voice generator circuit capable of conveying said warning information.

6. The apparatus of claim (1) where the sensor comprises a temperature sensor capable of distinguishing between temperature conditions which are either comfortable, uncomfortable or dangerous to said vehicle occupant and a circuit which causes temperature information to be transmitted to the receiver at predetermined intervals.

7. A method for monitoring a condition within a vehicle comprising the following steps:

Detecting sounds made by an occupant of said vehicle, sensing environmental conditions within said vehicle which could be potentially dangerous to an occupant of said vehicle by using a sensor generating warning information representative of the dangerous condition sensed by said sensor producing an alarm which incorporates said warning information and said sounds made by said occupant.

8. The method of claim (7) in which one of the following conditions is sensed:

temperature within the vehicle level of a dangerous gas within the vehicle sound inside the vehicle motion in the vicinity of the vehicle.

9. The method of claim (7) including the further step of transmitting the warning information to a remote receiver.

10. The method of claim (9) including the further step of producing an alarm sound at the receiver, said alarm sound being representative of said warning information.

11. The method of claim (10) in which the alarm sound comprises one of the following:

a human voice stating the warning condition a human voice stating the temperature inside the vehicle a buzzing sound a whistle sound an amplified version of the sound sensed within the vehicle.

12. The method of claim 7 including the further step of producing an alarm sound at the vehicle location such that the alarm sound comprises one of the following:

a human voice stating the warning condition a human voice calling for help an amplified version of the sound sensed within the vehicle.

13. The method of claim (12) in which the alarm sound comprises one of the following:

a human voice stating the warning condition a human voice calling for help a buzzing sound a whistle sound an amplified version of the sound sensed within the vehicle.

14. A new monitoring apparatus suitable for monitoring conditions inside a vehicle consisting of:

a sensor for sensing conditions potentially dangerous to an occupant of said vehicle and for generating warning information, a transmitter for transmitting said warning information to at least one of a wireless telephone, a telephone, or a pager.

* * * * *

UNITED STATES PATENT AND TRADEMARK OFFICE

CERTIFICATE OF CORRECTION

PATENT NO. : 6,639,512 B1
APPLICATION NO. : 09/115772
DATED : October 28, 2003
INVENTOR(S) : Kyu-Woong Lee and Aaron M. Jungreis It is certified that error appears in the above-identified patent and that said Letters Patent is hereby corrected as shown below:

Claim 14 should be changed to the following:

A monitoring apparatus suitable for monitoring conditions inside a vehicle consisting of:

a sensor for sensing conditions potentially dangerous to an occupant of said vehicle and for generating warning information, a transmitter for transmitting said warning information to at least one of a wireless telephone, a telephone, or a pager.

Signed and Sealed this

Second Day of January, 2007

JON W. DUDAS
*Director of the United States Patent and Trademark Office*